US005240448A

United States Patent [19]

Ishikawa

[11] Patent Number: 5,240,448

[45] Date of Patent: Aug. 31, 1993

[54] GLIDER PLANE SET

[76] Inventor: Paul J. Ishikawa, 626 Loma Dr., Hermosa Beach, Calif. 90254

[21] Appl. No.: 830,023

[22] Filed: Jan. 31, 1992

[51] Int. Cl.[5] ..... A63H 27/14; A63H 27/00

[52] U.S. Cl. ..... 446/64; 446/61; 446/68; 446/230

[58] Field of Search ..... 446/61, 62, 63, 64, 446/65, 66, 67, 68, 230, 231, 429

[56] References Cited

U.S. PATENT DOCUMENTS

| | | | |
|---|---|---|---|
| 1,408,001 | 2/1922 | Hauck | 446/67 X |
| 2,313,948 | 3/1943 | Lambert | 446/64 |
| 2,621,441 | 12/1952 | Worden | 40/455 X |
| 2,870,569 | 1/1959 | Bergstrand | 446/68 |
| 3,909,976 | 10/1975 | Kirk | 446/61 |
| 4,012,865 | 3/1977 | Fields | 446/67 X |
| 4,119,283 | 10/1978 | DeYarman | 446/61 X |
| 4,446,213 | 8/1984 | Alberico et al. | 446/64 X |
| 4,642,062 | 2/1987 | Dorffer | 446/68 |
| 4,863,413 | 9/1989 | Schwartz | 446/68 X |
| 4,915,664 | 4/1990 | Bakker | 446/62 |
| 5,057,050 | 10/1991 | Hill | 446/61 X |
| 5,073,137 | 12/1991 | Miller et al. | 446/61 |

FOREIGN PATENT DOCUMENTS

| | | | |
|---|---|---|---|
| 1063504 | 8/1959 | Fed. Rep. of Germany | 446/231 |
| 618283 | 3/1927 | France | 446/61 |
| 2021960 | 12/1979 | United Kingdom | 446/61 |
| 1578956 | 11/1980 | United Kingdom | 446/61 |

*Primary Examiner*—Robert A. Hafer
*Assistant Examiner*—D. Neal Muir
*Attorney, Agent, or Firm*—Price, Gess & Ubell

[57] ABSTRACT

A set of glider planes formed in the shape of actual fighter aircraft are provided. Each glider includes a flat front portion having the profile of a fighter aircraft and bearing a graphical depiction of the fighter aircraft. To improve the aerodynamics of the gliders, each glider includes a generally circular flat rear portion extending rearwardly from the front portion. The rear portion may include a graphic depiction of exhaust plumes. The glider is inexpensively constructed of a foam laminate material and is launchable by means of a common household elastic band. A launching base, configured in the shape of a miniature aircraft helmet, is provided. The launching base has a hollow cavity sized to mount securely over the left thumb of a child. An elastic band connects the launching base to the glider to provide a launching mechanism.

15 Claims, 6 Drawing Sheets

GLIDER PLANE SET

BACKGROUND OF THE INVENTION

Field of the Invention

The invention generally relates to toy gliders.

Description of Related Art

A wide variety of toy gliders have been designed. The dimensions and wing profile of a conventional toy glider are selected solely to provide adequate aerodynamic lift for the glider. As such, the dimension and wing profile typically do not resemble that of an actual aircraft; i.e., the glider does not represent a scale model replica of an actual aircraft. Only a few attempts have been made to design toy gliders with wing profiles similar to real aircraft, i.e., a glider comprising an approximate scale model of an actual aircraft, with the wings, fuselage, and tail sized proportionately.

Of these, no known glider replicas of fighter craft, such as the Stealth Fighter or the F-22 Lightning II Fighter, have been successfully developed. Failure may be attributed to the fact that an aircraft-shaped glider is not aerodynamic when scaled to the size and weight of a toy glider and when propelled at the velocities typical of toy gliders.

Also, many conventional toy gliders are merely tossed manually into the air. As such, conventional gliders have no launching mechanism. Launching mechanisms that have been developed can be cumbersome, unreliable, and not sufficiently durable to allow for long term use.

SUMMARY OF THE INVENTION

Accordingly, it is an object of the invention to provide a toy glider having the approximate wing profile of an actual aircraft;

Another object of the invention is to provide such a toy glider with a launch mechanism for hurling the glider into the air to enable the glider to float freely; and It is another object of the invention to construct such a toy glider from inexpensive and durable parts for inexpensive manufacture.

These and other objects of the invention are achieved by a toy glider comprising a front portion having a body, a pair of wings, and a tail collectively formed with the approximate perimeter of an actual aircraft. A rear portion extends rearwardly from the tail. The rear portion has a shape selected to provide aerodynamic stability for the glider. By including the rear portion, an aerodynamic toy glider is achieved having the approximate profile of an aircraft. The glider of the invention thus is able to glide effectively, an ability easily achieved in a glider having solely the profile of an aircraft.

In accordance with one embodiment, a launching means is provided for launching the toy glider into the air to allow it to glide freely.

In a preferred embodiment, the front portion of the glider is provided with a graphical representation of a fighter aircraft. The rear portion is provided with a graphical representation of a jet exhaust plume. The front portion of the glider may be configured with a profile of any of a variety of jet fighter aircraft, such as the F117A Stealth Fighter, the B2 Stealth Bomber, the A-10 Thunderbird II, or the F-22 Lightning II Jet Fighter.

The launching means includes a launching base member formed in the shape of a miniature aircraft helmet having an internal cavity. The internal cavity of the launching base member is adapted for mounting over the thumb of a hand, preferably that of a child. A top portion of the launching base member includes a slot for securely receiving one end of an elastic band. The other end of the elastic band detachably attaches to a hook or post extending from a bottom surface of the toy glider. In use, the launching base member is positioned over the thumb of one hand to secure one end of the elastic band to the thumb, the other end of the elastic band is attached to the hook, and the toy glider is pulled away from the hand to tension the elastic band. The toy glider is released, and rapid contraction of the elastic band propels the glider into the air.

The glider is preferably constructed of a durable lightweight foam laminate. A balancing weight may be provided on the front portion of the glider to advance the center of gravity of the aircraft to further improve aerodynamic stability.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a toy glider having the profile of an aircraft, yet being aerodynamic.

Figure 1:
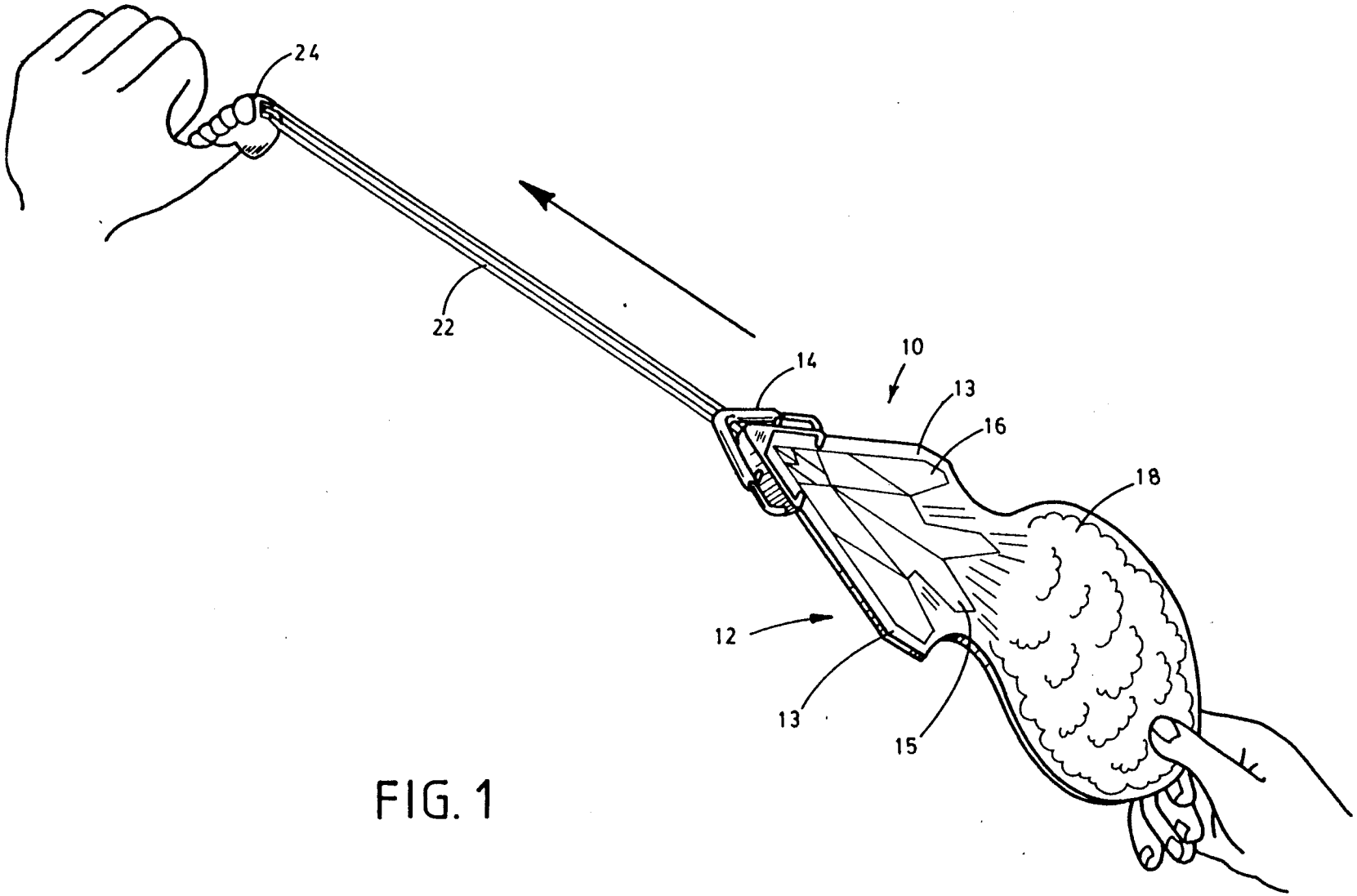
FIG. 1 is a perspective view of a toy glider constructed in accordance with a preferred embodiment of the invention, the glider being shown in combination with launching mechanism mounted to a child's left hand; a front portion of the glider is formed with the approximate profile of a F117A Stealth Fighter and is provided with a graphic representation of same.
Figure 2A:
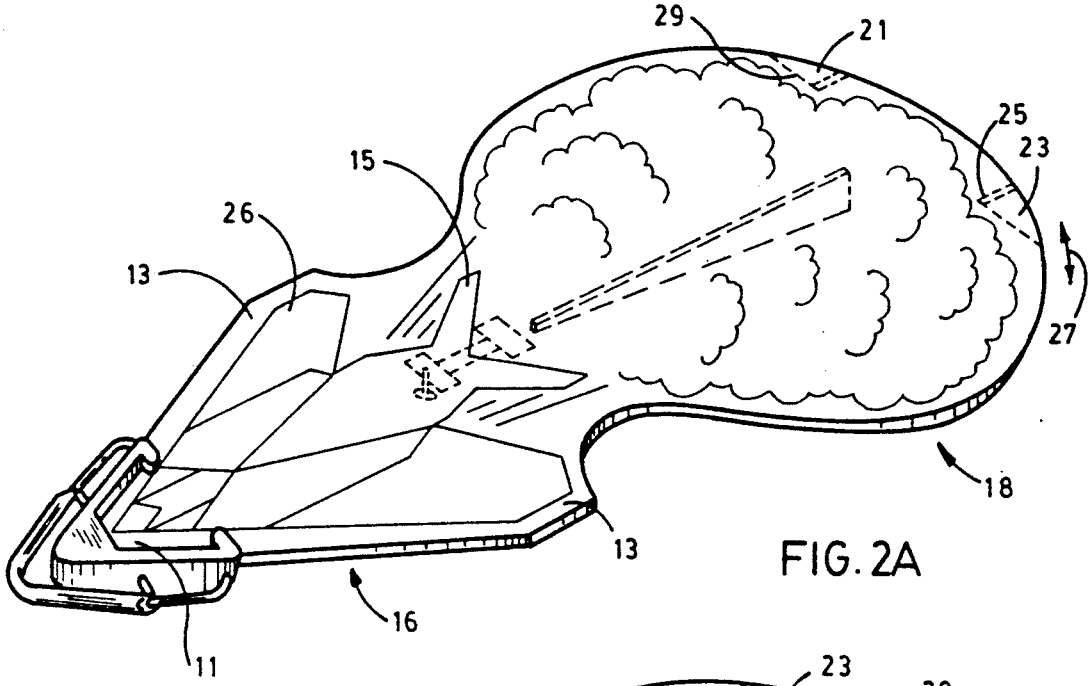
FIG. 2*a* is an upper perspective view of the toy glider of FIG. 1.
Figure 2B:
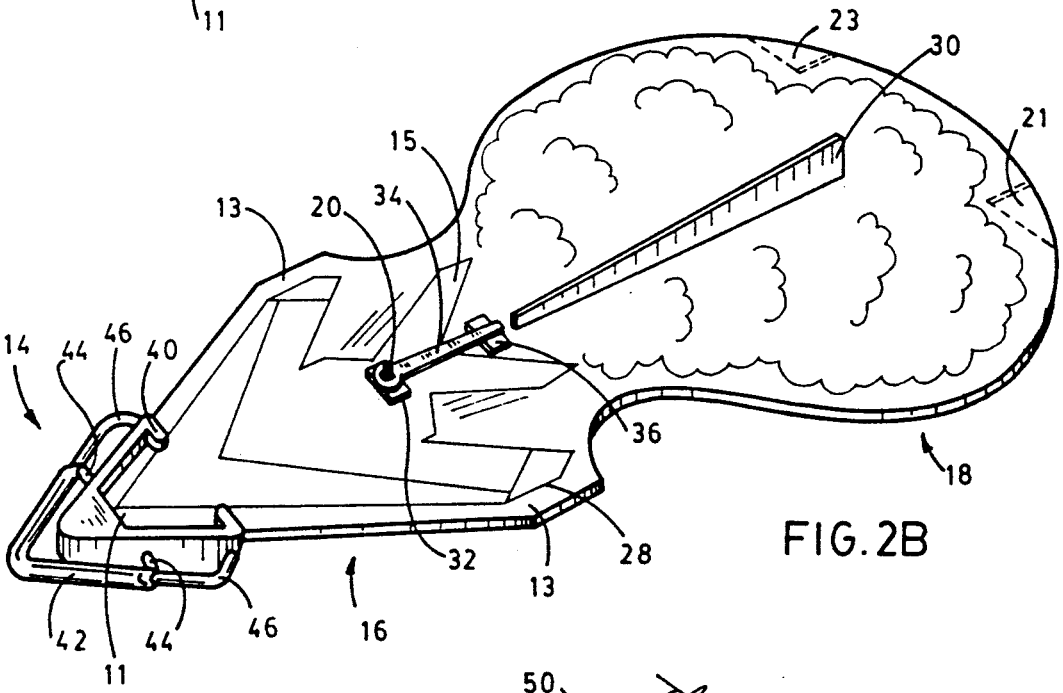
FIG. 2*b* is a lower perspective view of the glider of FIG. 1.
Figure 3:
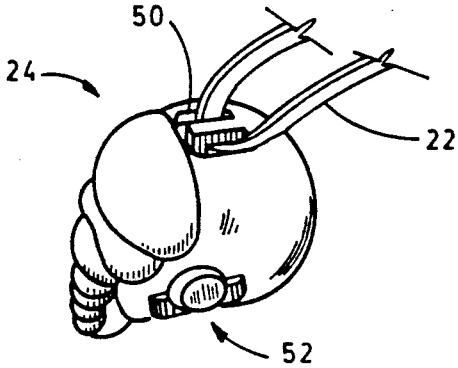
FIG. 3 is a perspective view of the launching mechanism of FIG. 1.

Referring to FIGS. 1–3, a preferred embodiment of the invention will now be described.

A glider 10 includes a flat front portion 16, having the profile of a jet fighter aircraft, integrally formed with a flat, generally circular rear portion 18. Front portion 16 includes a body with a nose 11, a pair of opposing wings 13, and a tail portion 15. A bumper 14 mounts to the apex of nose 11. The tail generally represents a rear portion of the body of the aircraft.

A rigid post or hook 20, shown in FIGS. 2A and 2B, depends from a bottom surface of glider 10. An elastic band 22 (shown in FIG. 1) attaches to post 20 to connect post 20 to a launching base member 24. Launching base member 24 is a hollow, generally cylindrical member having an open cavity adapted to securely fit over the thumb of a person, preferably that of a child. As will be described below with reference to FIG. 3, launching base member 24 includes means for securely holding one end of the elastic band.

In use, launching base member 24 is firmly mounted over the thumb of one hand to secure one end of the elastic band to the thumb. The other end of elastic band 22 is attached to post 20, and glider 10 is pulled away from the hand, thus tensioning elastic band 22. After stretching elastic band 22 a suitable distance, glider 10 is released, and rapid contraction of elastic band 22 propels glider 10 skyward. Launching base member 24 and elastic band 22 remain mounted to the thumb. During launch, elastic band 22 becomes disengaged from post 20, allowing glider 10 to fly freely. The launching base may be held firmly between the thumb and forefingers.

Launching base member 24 ensures that elastic band 22 does not also fly freely, but remains attached to the base member. By enclosing the thumb, launching base member 24 protects the thumb from impact with either the glider or the recoiling elastic band. Thus, base member 24 serves the functions of providing a means for securely mounting the elastic band to the thumb of one hand, preventing the base from flying freely after launch, and protecting the thumb from injury during launch.

The front and rear portions of glider 10 are preferably constructed of an integral durable, lightweight plastic foam laminate having a central foam core covered with a smooth paper surface on each side. The paper can receive appropriate graphics to further provide a realistic simulated plane, such as the graphic representation shown in FIG. 1.

After launching, glider 10 glides until landing on the ground or striking an object such as a wall. Bumper 14 is provided to cushion the impact of glider 10 to protect both the glider and the impacted object from possible damage. Bumper 14 is constructed of a resilient polyethylene material.

Glider 10 is shown in greater detail in FIGS. 2*a* and 2*b*. As can be seen, front portion 16 is shaped with the profile of a jet fighter aircraft, taken in horizontal cross-section through the aircraft, specifically an F117A Stealth Fighter. A graphic representation of the jet fighter is provided on the upper and lower surfaces of front portion 16. As can be seen from a comparison of FIGS. 2*a* and 2*b*, a top plan view of the fighter aircraft is graphically shown on a top surface 26, whereas a bottom plan view of the fighter aircraft is shown on a bottom surface 28 of the glider.

The lateral profile of the front portion of the glider is configured to approximately match the perimeter of an aircraft, preferably a fighter aircraft. Thus, a graphic representation of the aircraft is provided on a portion of the glider configured with the profile of the aircraft. This provides a suitably realistic scaled representation profile of a jet fighter. As can be seen from the figures, the graphical representation of the aircraft may be somewhat smaller than the profile of the front portion of the glider, i.e., the graphic does not extend to the edges of the glider.

The generally circular rear portion 18 includes a graphical representation of an exhaust plume. Both the upper and lower surfaces of the rear portion can include similar representations of an exhaust plume. Alternatively, either the upper or lower surface may include a textual description of the actual aircraft, along with specifications such as size, weight, and armaments.

The shape of rear portion 18 is selected to improve the aerodynamic stability of the glider as a whole. It has been found that a glider shaped solely with the profile of a jet fighter aircraft is not suitably aerodynamic. However, with the inclusion of the generally circular rear portion 18 extending rearwardly from tail 15, the aerodynamics of the glider are greatly improved to allow the glider to travel for considerable distances. As can be seen from the figures, rear portion 18 has a surface area somewhat greater than the surface area of the front portion, and includes a more rounded periphery.

By including a graphic depiction of an exhaust plume over rear portion 18, the overall visual effect and realism of the glider is improved.

A pair of flaps or tabs 21 and 23 are formed along a rear edge of rear portion 18. Flaps 21 and 23 are formed by providing a pair of parallel cuts 25 within rear portion 18. As a consequence of the cuts, flaps 21 and 23 may be bent upwardly or downwardly, as shown by arrow 27. That is, flaps 21 and 23 pivot along a line 29. By bending the flaps upwardly or downwardly, the characteristics of the flight of the glider can be varied. For example, by bending one flap upwards and the other downwards, the glider can be caused to turn to the left or right during flight.

As will be evident below with reference to alternative embodiments, the exact shape of rear portion 18 need not be circular. Rather, a variety of profiles may be employed within the scope of the invention to improve the aerodynamics of the glider to compensate for the jet glider profile of the front portion, thereby providing a suitably flight-worthy glider.

To further improve the aerodynamics of glider 10, a longitudinal fin or stabilizer member 30 is mounted to the bottom surface of the glider along a longitudinal axis of the glider. Fin 30 is a generally flat, rigid member which increases in size towards a rear end of the glider. Fin 30 may be affixed to the bottom of glider 10 by a variety of means, including suitable adhesives. Fin 30 may be constructed from a variety of lightweight materials, including foam laminate.

Referring to FIG. 2*b*, the structure of post 20 is shown in detail. Post 20 is mounted to bottom surface 20 of forward portion 16 by a mounting base 32. A longitudinally-extending rigid member 34 connects post 20 to a second base member 36 mounted immediately forward from fin 30. Both base members 32 and 36 may be affixed to glider 10 by a variety of means, including suitable adhesives.

Although not shown in FIG. 2*b*, elastic band 22 hooks over post 20. Brace member 34 is provided to distribute torque occurring at the base of post 20 when elastic band 22 is tensioned. Brace member 34 thus helps prevent post 20 from being torn from the bottom surface of front portion 16. Post 20, brace 34, and base members 32 and 36 may be constructed of a lightweight plastic.

Also with reference to FIGS. 2*a* and 2*b*, the structure of front bumper 14 is shown. Bumper 14 includes a V-shaped base 40 mounted over a forward apex of nose 11. Bumper 14 also includes a V-shaped leading portion 42, slightly offset from V-shaped base 40. Leading portion 42 is mounted to base 40 via mounting members 44 and 46. As noted above, bumper 14 is preferably constructed of a resilient polyethylene material. The configuration of bumper 14 with offset leading portion 42 allows impact energy to be dissipated, thus protecting both glider 10 and objects impacted by glider 18 from damage. In this regard, leading portion 42 and mounting members 44 and 46 are preferably sufficiently resilient to bend and flex upon impact.

Launching base member 24 is shown in detail in FIG. 3, along with one end of elastic band 22. Launching base member 24 includes an upper U-shaped slot 50, into which elastic band 22 is securely attached. An outer surface of base member 24 is generally configured in the shape of a miniature jet fighter helmet, to thereby visually comport to the graphical representations of jet fighters provided on glider 10.

As noted above, launching base member 24 has a hollow cavity denoted in FIG. 3 by reference numeral 52. The internal cavity allows the base member to be mounted over a thumb, and is preferably sized to securely fit the thumb of a child. Launching base member 24 is constructed of a durable, but lightweight plastic of sufficient strength to securely hold elastic band 22 when elastic band 22 is tensioned. As noted above, launching base member 24 protects the thumb from impact from either the glider or the recoiling elastic band during launch. Base member 24 also prevents elastic band 22 from flying freely after launch. Thus, the elastic band remains attached to the base member, which remains mounted to the thumb.

Figure 4:
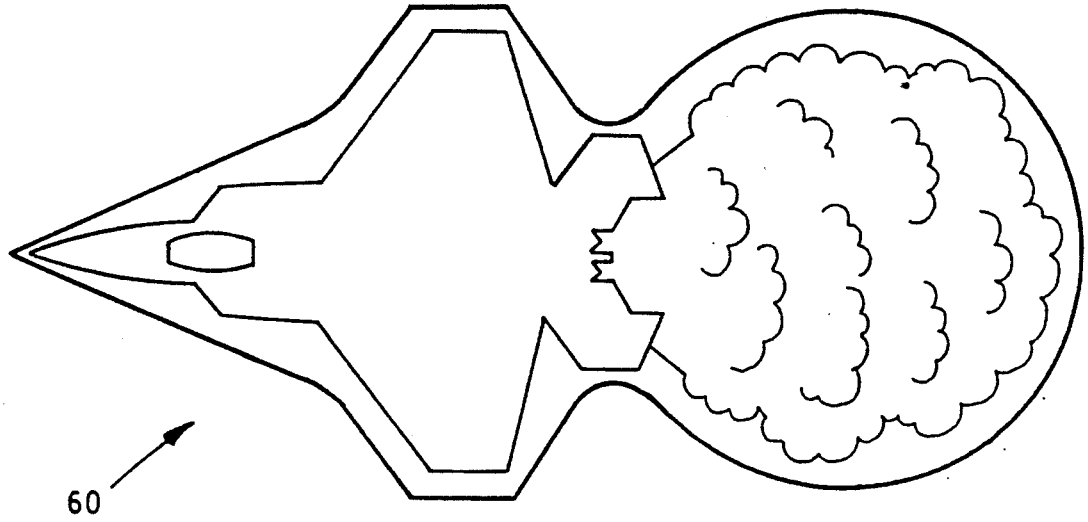
FIG. 4 is a top plan view of an alternative embodiment of the glider of FIG. 1, having a front portion with the profile of an F22 Lightning II Jet Fighter.
Figure 5:
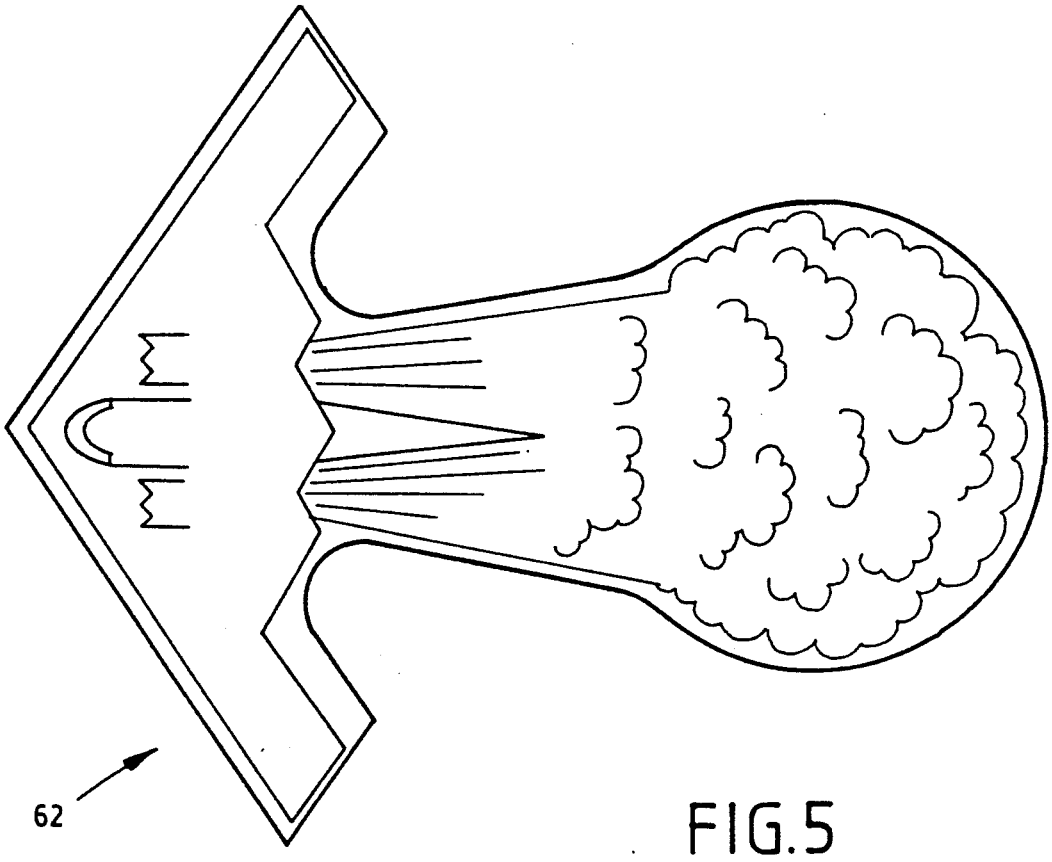
FIG. 5 is a top plan view of an alternative embodiment of the glider of FIG. 1, having a front portion with the profile of a B2 Stealth Bomber.
Figure 6:
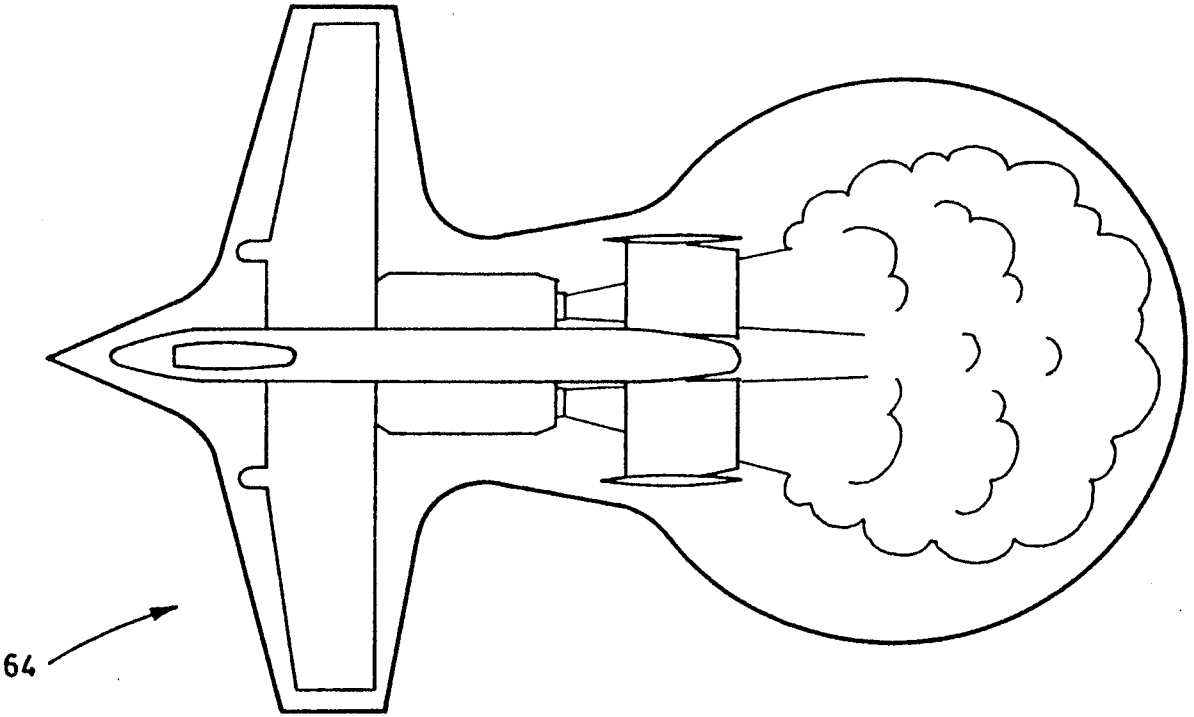
FIG. 6 is a top plan view of an alternative embodiment of the glider of FIG. 1, having a front portion with the profile of an A-10 Thunderbird II.

In FIGS. 4–6, top views of alternative configurations of glider 10 are shown. The alternative gliders, denoted 60, 62, and 64, respectively, each include similar circular rear portions. However, each alternative embodiment of the glider includes different front portion profiles corresponding to other fighter aircraft.

In FIG. 4, glider 60 includes a front portion having the profile of an F22 Lightning II Fighter. Glider 62 of FIG. 5 includes a front portion having the profile of a B2 Stealth Bomber. Glider 64 of FIG. 6 has a front portion having the profile of an A-10 Thunderbird II aircraft.

As can be seen from FIGS. 4–6, the respective gliders each include graphical representations of jet fighter aircraft along their front portions, and graphical representations of exhaust plumes over their rear portions. In each embodiment, the generally circular rear portion provides aerodynamic stability to compensate for the jet fighter profiles of the forward portions.

Figure 7B:
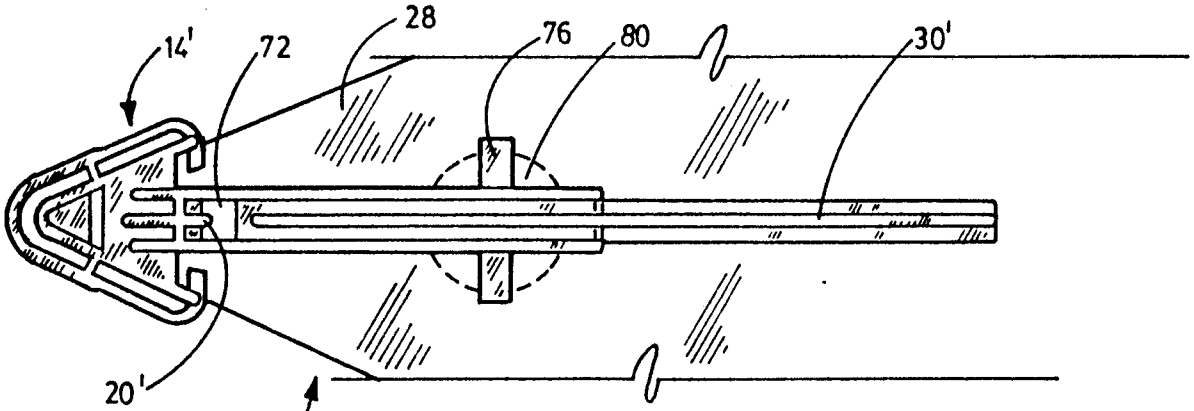
FIG. 7*b* is a partial bottom plan view of the alternative embodiment of FIG. 7*a*.
Figure 7A:
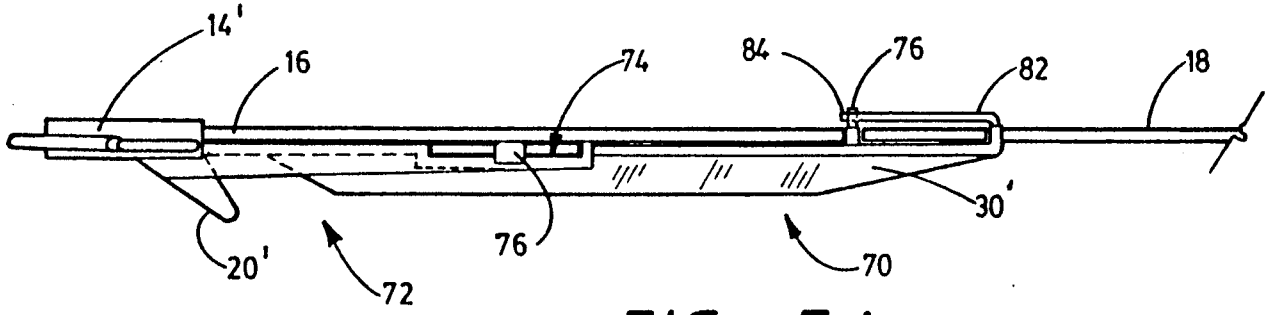
FIG. 7*a* is a partial side elevational view of an alternative embodiment of the glider of FIG. 1.

Referring to FIGS. 7*a* and 7*b*, an alternative embodiment of the invention is shown. The alternative embodiment of FIGS. 7*a* and 7*b* is similar to the previously-described embodiments. However, the separate bumper, post, and fin of the embodiment of FIG. 1 are replaced with a single longitudinal spine member 70 having a front bumper portion, a mounting post portion, and a fin portion. In FIGS. 7*a* and 7*b*, the bumper portion is identified by reference numeral 14', the post portion by 20', and the fin portion by 30'.

Post 20' is configured somewhat differently from post 20 of the preceding embodiments. Post 20' is mounted at an angle near nose 11 of the glider. A notch 72 is formed immediately behind post 20' and immediately forward of fin 30'. The launching elastic band (FIG. 1) is hooked into notch 72 behind post 20' such that the alternative glider may be launched in the same manner as described above. The angle of post 20' helps secure the elastic band on the post during launch.

In addition to providing a bumper, a mounting post, and a fin, spine member 70 includes a slot 74 for allowing a weight member 80 of a cylindrical configuration, such as a penny coin or the like, to be inserted directly beneath the front portion of the glider. The inserted penny (shown in phantom lines in FIG. 7B) is provided to move the center of gravity of the glider forward along a longitudinal axis of the glider to improve the aerodynamics of the glider. Spine member 70 includes two opposing flange members 76, only one of which is shown in FIG. 7*a*, for securing the balance weight.

Bumper member 14' includes an internal V-shaped slot for mounting over the front apex of the glider. Spine member 70 includes an upwardly-extending post 76 provided for mounting through a hole within the glider. A rear flange 82 of spine 70 extends through a second hole in the glider and attaches to post 76. To this end, flange 82 includes a ring 84 for snapping over post 76. Preferably, flange 82 is sufficiently resilient such that, during assembly, the flange can be easily inserted through the second hole of the glider, then bent forward to snap over mounting post 76. Thus, spine 70 is secured to the body of the glider at two locations; namely, the bumper of the spine mounts over the front apex of the glider, and the rear flange of the spine mounts through a hole in the glider to snap over a post inserted through the glider. In this manner, the spine is easily and firmly secured to the glider without the need for adhesives. However, an adhesive may also be used.

Figure 8:
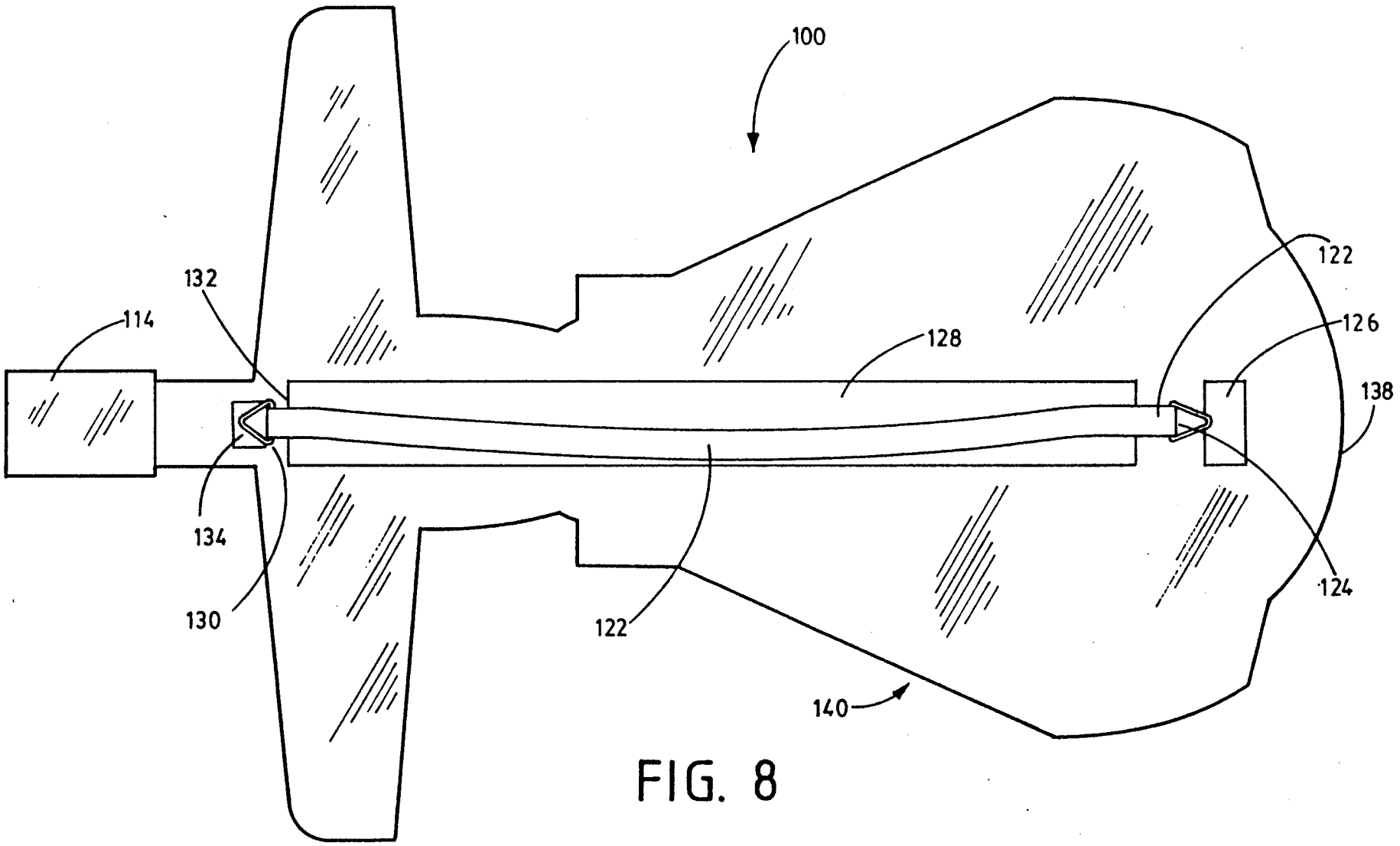
FIG. 8 is a bottom plan view of another alternative embodiment of the glider of FIG. 1.

Another alternative embodiment of the glider is shown in FIG. 8. In FIG. 8, a glider 100 is shown having means for carrying an elastic band 122. A rear end 124 of elastic band 122 is mounted to a mounting base 126 affixed near a bottom rear edge of the glider. A housing 128, having a semicircular cross-section, is provided along the central longitudinal axis of the bottom surface of the glider for holding elastic band 122. A free forward end 130 of elastic band 122 extends from a forward opening 132 of housing 128. A manually-holdable tab member 134 is mounted or affixed to the free end of the elastic band.

Glider 100 may be launched by holding tab 134 between the thumb and forefinger of one hand and pulling the glider away with the other hand to tension the elastic band. Glider 100 is then released and release of tension within the elastic band begins to propel the glider forward. Immediately thereafter, tab 134 is released, thus allowing elastic band 122 to retract into housing 128, where it remains during the flight of the glider. In this manner, the elastic band launching means is carried with the glider such that a separate elastic band and separate launching base need not be used.

Glider 100 includes a simplified front bumper 114 comprised of a foam or elastic material and mounted over the forward edge of the glider. Like the previous embodiments, the front portion of the glider may be configured in a variety of shapes to correspond to the profile of aircraft. A rear portion is provided to improve the stability of the glider. In the embodiment of FIG. 8, the rear portion has a generally circular rear edge 138 and a generally V-shaped middle portion 140. As with the previous embodiments, the rear portion is provided with a graphical representation of an exhaust plume, whereas the forward portion is provided with a graphical representation of an aircraft. Although not shown, the glider of FIG. 8 may also be provided with a weight mounted along a forward portion of the glider to advance the center of gravity forward along the glider to improve the aerodynamics of the glider.

In any of its embodiments, in addition to being launchable by means of the elastic band, the glider may be launched manually by grasping the glider in one hand and hurling the glider skyward.

Thus, the invention in its various embodiments provides a set of gliders having the profile of fighter aircraft. The gliders have a forward portion shaped in the profile of the aircraft and carrying a graphic depiction of the fighter aircraft. A larger, less angular rear portion is provided to improve the aerodynamic stability of the glider. The rear portion may be provided with a graphic depiction of an exhaust plume. Of course, the rear portion may alternatively include any of a variety of other graphical representations or none at all. Likewise, the forward portion may include any of a variety of graphical representations or none at all.

The gliders are inexpensively constructed of few parts and may be launched by a conventional household elastic band or manually grasped and thrown into the air.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A toy glider comprising:

a substantially flat front portion having a body formed with an approximate perimeter configuration, in miniature size, of an actual aircraft;

a rear portion integrally formed with, and extending generally rearwardly from said front portion, said rear portion being sized and shaped to provide improved straight-line aerodynamic stability to the front portion; and launching means connected to said glider for propelling said glider including an elastic band, a connection member extending from a bottom surface of said glider, and a launching base member, the elastic band having a first end detachably hooked to the connection member and the second end attached to the launching base member, the elastic band being stretchable to a tension to propel the glider, wherein the launching base member includes an internal cavity for mounting securely over the thumb of a hand, a top enclosed portion of the launching base member having a slot for receiving and securing the second end of the elastic band.

2. The toy glider of claim 1, wherein the launching base member has an outer surface configured to represent a miniature fighter pilot helmet.

3. The toy glider of claim 1, wherein the front portion of the glider includes a graphical representation of a fighter aircraft.

4. The toy glider of claim 1, wherein the rear portion of the glider includes a graphical representation of an exhaust plume.

5. The toy glider of claim 1, wherein the front portion has the profile of an F117A Stealth Bomber.

6. The toy glider of claim 1, wherein the front portion has the profile of an F-22 Lightning II fighter aircraft.

7. The toy glider of claim 1, wherein the front portion has the profile of a B-2 Stealth Bomber.

8. The toy glider of claim 1, wherein the front portion has the profile of an A-2 Thunderbolt II aircraft.

9. The toy glider of claim 1, wherein the rear portion is generally circular.

10. The toy glider of claim 1, wherein said glider includes a bumper member attached to a nose of the front portion.

11. The toy glider of claim 1, wherein the front and rear portions of the glider are comprised of a single, generally flat, integral foam laminate member.

12. The toy glider of claim 1, wherein the glider is further provided with a balancing weight attached to the front portion thereof.

13. The toy glider of claim 1, further including a fin mounted to a surface of the glider, said fin being aligned along a central longitudinal axis of the glider.

14. The toy glider of claim 1, wherein the rear portion has a total surface area greater than a total surface area of the front portion.

15. A toy glider comprising:

a flat front portion having a body formed with approximate perimeter configuration, in miniature size, of a actual aircraft, segments of the flat front portion having indicia simulating outlines of wings and tail of the aircraft;

a flat rear portion integrally formed with, and extending generally rearwardly from said simulated tail of said front portion, said rear portion being sized and shaped to provide aerodynamic stability to the front portion;

elastic launching means connected to said glider for launching said glider; and a launching base member including an internal cavity for mounting securely over the thumb of a hand, a top enclosed portion of the launching base member having means for connecting to said elastic means, whereby said elastic means is stretchable between the glider and the base member for generating tension to launch said glider.

* * * * *